US006893469B1

(12) United States Patent
Van Hauwermeiren et al.

(10) Patent No.: US 6,893,469 B1
(45) Date of Patent: May 17, 2005

(54) METHOD FOR CLEANING AND REFRESHING FABRICS

(75) Inventors: Tim Maria Joris Van Hauwermeiren, Ramsdonk (BE); Jean-Luc Philippe Bettiol, Brussels (BE); Marianne mai Anh Bouvette, Strombeek-Bever (BE); Joost Ignace Dewaele, Vichte (BE); Merih Pasin, Brussels (BE); Eddy Vos, Linden (BE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/049,735

(22) PCT Filed: Mar. 1, 2000

(86) PCT No.: PCT/US00/05200

§ 371 (c)(1),
(2), (4) Date: Feb. 15, 2002

(87) PCT Pub. No.: WO00/52249

PCT Pub. Date: Sep. 8, 2000

Related U.S. Application Data

(60) Provisional application No. 60/122,418, filed on Mar. 2, 1999.

(30) Foreign Application Priority Data

Feb. 7, 2000 (EP) ..... 00870018

(51) Int. Cl.[7] ..... D06B 1/00; D06F 35/00
(52) U.S. Cl. ..... 8/149.1; 8/149.2
(58) Field of Search ..... 8/149.2, 149.3, 8/158; 68/5 R, 6, 5 C

(56) References Cited

U.S. PATENT DOCUMENTS

| | | | | | |
|---|---|---|---|---|---|
| 3,601,292 | A | * | 8/1971 | Bliss | 68/6 |
| 3,739,496 | A | * | 6/1973 | Buckley et al. | 34/210 |
| 4,186,571 | A | * | 2/1980 | Gorodissky et al. | 68/5 E |
| 4,199,916 | A | * | 4/1980 | Shishoo | 53/434 |
| 4,391,602 | A | * | 7/1983 | Stichnoth et al. | 8/149.1 |
| 4,761,305 | A | | 8/1988 | Ochiai | 427/180 |
| 5,305,484 | A | | 4/1994 | Fitzpatrick et al. | 8/149.3 |
| 5,528,912 | A | * | 6/1996 | Weber | 68/6 |
| 5,649,372 | A | | 7/1997 | Souza | 34/491 |
| 5,730,006 | A | * | 3/1998 | Conley | 68/6 |
| 5,789,368 | A | | 8/1998 | You et al. | 510/297 |
| 5,815,961 | A | | 10/1998 | Estes et al. | 38/14 |
| 5,908,473 | A | * | 6/1999 | Weller et al. | 8/142 |

FOREIGN PATENT DOCUMENTS

| | | | |
|---|---|---|---|
| DE | 2357646 | 5/1975 | |
| DE | 2433909 | 2/1976 | D06F/87/00 |
| FR | 2704008 | 10/1994 | D06F/73/00 |

* cited by examiner

*Primary Examiner*—Frankie L. Stinson
*Assistant Examiner*—Joseph L. Perrin
(74) *Attorney, Agent, or Firm*—Robert O. Rice; John F. Colligan; Stephen Krefman

(57) ABSTRACT

A method for treating a fabric article with the following steps: placing the fabric article in a container having an opening and at least one wall that defines an interior void space. Then the temperature and relative humidity of the air within the interior void space of the container are raised to a predetermined first temperature and a predetermined first relative humidity for a predetermined first period of time. Finally, at least one of the temperature or the relative humidity of the air within the interior void space of the container are changed at the end of the first period of time to a predetermined second temperature and a predetermined second relative humidity for a predetermined second period of time.

31 Claims, No Drawings

METHOD FOR CLEANING AND REFRESHING FABRICS

This application claims the benefit of provisional application No. 60/122,418 filed Mar. 2, 1999.

TECHNICAL FIELD

The present invention relates to methods useful for cleaning and refreshing fabrics in a non-immersion cleaning process. Temperature and relative humidity are controlled in the multi-step processes of this invention.

BACKGROUND OF THE INVENTION

Certain delicate fabrics are not suitable for conventional in-home immersion cleaning processes. Home washing machines, which provide excellent cleaning results for the majority of fabrics used in today's society, can, under certain conditions, shrink or otherwise damage silk, linen, wool and other delicate fabrics. Consumers typically have their delicate fabric items "dry-cleaned". Unfortunately, dry-cleaning usually involves immersing the fabrics in various hydrocarbon and halocarbon solvents that require special handling and the solvent must be reclaimed, making the process unsuitable for in-home use. Hence, dry-cleaning has traditionally been restricted to commercial establishments making it less convenient and more costly than in-home laundering processes.

Attempts have been made to provide in-home dry-cleaning systems that combine the fabric cleaning and refreshing of in-home, immersion laundering processes with the fabric care benefits of dry-cleaning processes. One such in-home system for cleaning and refreshing garments comprises a substrate sheet containing various liquid or gelled cleaning agents, and a plastic bag. The garments are placed in the bag together with the sheet, and then tumbled in a conventional clothes dryer. In a current commercial embodiment, multiple single-use flat sheets comprising a cleaning/refreshing agent and a single multi-use plastic bag are provided in a package.

Unfortunately, these prior processes often involved only one step with regards to temperature and relative humidity. That is, the tumble dryer was set for a particular temperature and time. The humidity in the bag was a function of the moisture loaded in the bag and the temperature setting. But once the time and temperature were selected, the one step process was set. Moreover, when using a conventional tumble dryer, the consumer is often limited to the manufacturer's pre-set temperature conditions, which are established for drying clothes, not for cleaning and refreshing them. Often these manufacturer's conditions are sub-optimal with respect to one or more of dewrinkling, deodorizing, and optionally perfume deposition.

Moreover, such in-home processes are designed for use in a conventional clothes dryer, or the like apparatus. Such apparatuses are not always readily available, they are often uneconomical, and in many countries clothes dryers are simply unnecessary. For example, in many warm tropical regions people do not typically own clothes dryers because their clothes can be dried year-round by hanging them outside in the sun. In the areas of the world where people do not typically own clothes dryers, products that require a heating apparatus, such as a clothes dryer, are of little or no value.

Steamer cabinets have also been utilized in the art to treat fabric articles with heavy doses of steam. Unfortunately, these high temperature, high relative humidity processes can have negative effects on fabric articles. In addition to the harsh effect on fabrics, a drying step is often required that puts even further strain on the fabrics. The drying step also requires additional time and energy, and often results in undesirable shrinkage. And finally, steamer cabinets are typically wasteful with respect to steam because it is only water.

Thus, there is a need to develop a domestic, non-immersion cleaning and refreshing process, and cleaning and refreshing compositions for use therein, which provides acceptable cleaning without the need for a tumble dryer.

It has now also been unexpectedly discovered that by regulating temperature and relative humidity within a container during a domestic, non-immersion cleaning and refreshment process, dry clean only fabrics are cleaned, dewrinkled and refreshed. The present invention provides such methods for cleaning and refreshing fabrics.

SUMMARY OF THE INVENTION

In one aspect of the present invention there is provided a method for treating at least one fabric article comprising the steps of: a) placing the fabric article in a container having an opening and at least one wall that defines an interior void space; b) raising the temperature and relative humidity of the air within the interior void space of the container to a predetermined first temperature and a predetermined first relative humidity for a predetermined first period of time; and c) changing at least one of the temperature or the relative humidity of the air within the interior void space of the container at the end of the first period of time to a predetermined second temperature and a predetermined second relative humidity for a predetermined second period of time.

In a preferred aspect of this invention, the fabrics are contacted with an aqueous composition prior to be placed in a container according to step a) defined below.

In another preferred aspect of this invention vapor is used to raise the temperature and relative humidity of the air within the interior void space of the container, and more preferably the vent remains open at all times. In another aspect of this invention the vapor introduced into the interior void space of the container comprises water and a perfume.

In yet another aspect of the present invention there is provided a method for treating a fabric article comprising the steps of: a) placing the fabric article in a container having an opening and at least one wall that defines an interior void space; b) introducing ozone into the interior void space for a predetermined first period of time; and c) changing at least one of the temperature or the relative humidity of the air within the interior void space of the container at the end of the first period of time to a predetermined second temperature and a predetermined second humidity for a predetermined second period of time. The ozone can be generated by an ozone source, such as an ultraviolet lamp, or even a high voltage source, within the interior void space of the container. Preferably, the level of ozone that is provided within the container is between 0.5 and 200 ppm, preferably between 0.5 and 50 ppm, more preferably between 0.5 and 20 ppm. Levels lower than 0.5 ppm are not preferred as they would not provide sufficient bleaching performance and consequently not provide sufficient performance of the benefit linked to the bleach property.

The present invention provides benefits over the prior art by defining the optimal process steps for cleaning and refreshing delicate fabric articles in an in-home non-immersion cleaning process. The methods of this invention can be carried out in any appropriate container, such as a plastic bag, a wardrobe, a cabinet, or a tumble dryer.

Unlike many prior processes, the methods of this invention involve at least two distinct steps, and preferably three steps. It has been surprisingly found that the optimal conditions for deodorizing a fabric article differ from the conditions that are best for dewrinkling. Likewise perfume deposition onto a fabric article requires a third set of conditions for optimal performance. In the multi-step processes of this invention temperature, relative humidity or both can be manipulated and controlled. Alternatively, one step of the process can involve the introduction of ozone into the container to neutralize odor causing chemicals on the fabric articles being cleaned and refreshed.

Further the present invention provides a method of delivering an active ingredient, for example, perfume, to the fabrics being treated. Simultaneously, the methods herein minimize the amount of vapor delivered so that the actives are not wasted. And finally, the methods herein are designed to deliver only enough vapor to accomplish the fabric treatment process, without the need for additional mechanical drying.

DETAILED DESCRIPTION OF THE INVENTION

The present invention provides methods for cleaning and refreshing fabric articles in a domestic, non-immersion process. The methods require at least two steps, and preferably three. The methods can be carried out in any appropriate apparatus wherein temperature and relative humidity can be manipulated and controlled. In another aspect of this invention, one of the method steps involves the introduction of ozone into the container to neutralize odor causing chemicals on the fabric articles being cleaned and refreshed.

A warm, humid environment inside the container volatilizes malodor components in the manner of a "steam distillation" process, and moistens fabrics and the soils thereon. This moistening of fabrics can loosen pre-set wrinkles, and because the fabric articles are hung in the container new wrinkles do not form. Proper selection of the amount of the vapor, and specifically the amount of water used in the process and, importantly, proper venting of the container in the present manner can minimize shrinkage of the fabrics. Moreover, if the container is not vented, the volatilized malodorous materials removed from the fabrics, which are not captured by the filter if present, can undesirably be re-deposited thereon.

Relative humidity is a well known concept to those in the fabric care arts. As used herein, "relative humidity" means the ratio of the actual amount of water vapor in the air to the greatest amount possible at the same temperature.

Temperature and relative humidity controllers are well known to those skilled in the art, as are passive and active controllers. As used herein, an "active" controller is a controller that reads an input and supplies feedback to the device being controlled and that device adjusts based on the feedback received. A "passive" controller, as used herein, is a controller that turns a device on or off, or opens or closes a device, based on a predetermined setting such as time. For example, a passive temperature controller would turn on a heating element or close a vent to increase the temperature in a given environment and after a certain period of time the heating element is turned off or the vent is opened. In contrast, an active temperature controller reads the temperature and if, for example, the temperature is too low, the power to the heating element is increased or the vent is closed to increase the temperature.

Method

To properly clean and refresh a fabric article, one must address many aspects of the article's appearance. Specifically, the fabric article should at least be substantially free of odor and wrinkles after a cleaning and refreshing operation. It is often preferred that the article be perfumed to give it a pleasant odor, and it should be free of localized stains. The methods of this invention require at least two steps designed toward deodorizing, dewrinkling and/or perfume deposition on a fabric article. Additionally, a manual spot removal process for removing localized stains is provided, but the spot removal process is conducted outside of the apparatus The conditions for each of these methods steps are described in greater detail below.

While the method steps of this invention can be carried out in any appropriate order, the deodorization step will be discussed first. Deodorization must be distinguished from odor-masking, which involves applying a pleasant scent to a fabric to mask, or cover up the odors on the fabric. Deodorization, as used herein, involves the actual removal or neutralization of malodor causing chemicals. When the malodor causing constituents are removed or neutralized, the fabric article should have little or no residual odor. This step of the process can be carried out with ozone, which neutralizes odors, or with high temperatures and venting, and/or by filter capturing, which removes the odor causing constituents. The advantages of using ozone as a bleaching system is that this component provides an overall satisfactory colour safety, especially on cellulosic fabrics, a malodour reduction, stain removal, as well as sanitistion of the articles treated therewith.

The deodorization step, is described herein as the first step as a matter of convenience. It is understood that the deodorization and dewrinkling steps can be carried out in any order. If a perfume deposition step is employed, it necessarily should follow the deodorization step, so that the perfume is not stripped off of the fabric immediately after it is laid down.

Thus, when deodorization is the first step, the first temperature should be at least about 45° C., preferably at least about 60° C., and most preferably at least about 70° C. and the first relative humidity should be least about 20%. At these relatively high temperatures, odor causing chemicals are stripped off of fabrics, and then preferably removed from the container via the vent. Even more preferably, the vent comprises a filter so that the odorous emanations do not enter the environment outside of the container. When the first temperature and first relative humidity are reached, the process time, that is, the first time, can be from about 2 minutes to about 20 minutes, preferably from about 5 minutes to about 15 minutes, and even more preferably from about 8 minutes to about 12 minutes.

The deodorization step described above can be supplemented, or even replaced by treating the fabric articles with ozone, preferably incorporated at room temperature. The use of ozone to neutralize odors causing chemicals and to sanitize garments, for example, medical gowns, is well known to the art. Specifically see, published patent applications DE 24 33 909 and FR 2059 841, both of which are incorporated herein by reference. For purposes of the methods disclosed herein, ozone can be introduced into the container from any appropriate source, such as an ultraviolet lamp. One or more ozone sources can be used and they can be placed in any convenient place in, or adjacent the exterior of the container. The ozone source must be sized according to the volume of the container with consideration for the surface area of the fabric articles being cleaned and refreshed. Those skilled in the art will know what type and size of equipment to use for a given container.

The second step of the present invention is directed to dewrinkling, which requires relatively high temperature and relative humidity. Good air circulation is beneficial to the dewrinkling step, but not necessary. For the second step, i.e. the dewrinkling step, the second temperature should be greater than "T" as defined by the equation: $T=60-(0.17*RH_2)$, wherein $RH_2$ is the second relative humidity in percent. $RH_2$ is preferably of at least 50%, preferably of at least 75%, more preferably of at least about 85%, and even more preferably at least about 90%. Preferably, the second temperature is less than about 90° C., more preferably less than about 80° C., and most preferably less than about 70° C. When the second temperature and second relative humidity are reached, the process time, that is, the second time, can be from about 2 minutes to about 20 minutes, preferably from about 5 minutes to about 15 minutes, and even more preferably from about 8 minutes to about 12 minutes.

Finally, there is preferably a third step which involves a gradual cool down of the interior void space. As the temperature decrease, the amount of vapor that the air can retain in the air decreases, and when the air becomes saturated the vapors begin to condense. Naturally, vapors will condense on the fabric articles on the inside of the bag, and as these articles dry, the active ingredients, such as perfume, remain behind. As discussed briefly above, the methods steps of this invention are designed to deliver actives without undue waste and without saturating the fabrics to the point where they need additional drying. Preferably, during the third step in the process the temperature within the interior void space decreases to a third temperature wherein the third temperature is less than about 45° C., preferably less than about 40° C., and more preferably less than about 35° C. This third step can last for a third period of time, which can be from about 2 minutes to about 20 minutes, preferably from about 3 minutes to about 10 minutes, and even more preferably from about 3 minutes to about 5 minutes.

As discussed in greater detail below, the vapor inside the container is preferably a cleaning and refreshment composition. The cleaning refreshment composition can be added to the container directly, via a sheet/substrate, in a cartridge or any other means that will be known to those skilled in the art. Preferably, the cleaning and refreshment composition is in a cartridge that is introduced into the interior void space of the container and the cleaning and refreshment composition is released from the cartridge into the interior void space of the container.

Apparatus

The methods of this invention can be conducted in any appropriate apparatus. Such apparatuses require a container that substantially encloses the fabric articles being cleaned and refreshed. By "substantially encloses", it is meant that the fabric articles are enclosed in the container, but that the container can, and preferably will, include one or more vents. The container must have an opening to access the fabric articles, and preferably, there is a bar, hook or other device on which to hang the fabric articles. The garments hung in treatment apparatus can also be weighted or stretched to improve wrinkle reduction. Hanging weights and stretching devices will be known to those skilled in the art. Preferably, the garments to be treated are mechanically stretched after placing them into the container and before starting the process. This stretching or so-called tensioning of the garment helps the relaxation of wrinkles during the process. Preferred stretching systems include weighted clamps as well as light weight compactable or retractable stretching systems, wherein the system comprises a tensioning device like a spring. The latter systems have the benefit of not adding extra weight to the cleaning and refreshing apparatus, along with the possibility of adjusting tensioning force and direction as required. Preferably, these systems are mounted inside the container at its bottom. One example of such as system is a rollerblind that is conventionally used as sunfilter for cars and commercially available from Halfords. This system is a rollerblind which can be extended or compacted by means of a roll-up spring mechanism. Only slight modification of this system are needed to adapt it to the tensioning of garment. One preferred adaptation involves attaching the housing of this system at the bottom of the apparatus and providing one or more clamp at the other side so that the clamping and thus the stretching or tensioning of the garment in the apparatus is obtained. The tension of the spring can also be adjusted to the desired stretching force for a given garment. The size of the clamp can nary so that more than one clamp are attached to this system. Still, another variation involves having only one clamp which run along or partly along the blind tensioning system located opposite the housing of the system.

The container preferably has only one wall configured like an egg shell. It has been found that the vapor, and subsequently the active ingredients, preferentially condense in the corners and along the sharp edges of a more conventional rectangular shaped cabinet. This is not to say that the methods of this invention cannot be conducted in rectangular cabinets; they can. But the fewer sharp edges and corners the cabinet has, the more efficient it is. Thus, cabinets, wardrobes, and garment bags are all appropriate for use in the present invention. Moreover, a common tumble dryer may be an appropriate container, but these apparatuses do not normally have humidity controllers, nor do they have the ability to program a multi-step process with respect to both temperature and humidity. Thus, with some additional programming and controllers, a common tumble dryer could be used for the methods of this invention.

In addition to the at least one wall that defines an interior void space, the containers of this invention preferably comprise: a vent and/or filter; a heating element, which is capable of heating liquids to produce vapors and which can run dry to heat air; a humidity provider; and an air circulation device, for example, a fan. More preferably, the container additionally comprises an active temperature controller capable of changing and maintaining the air temperature within the interior void space of the container; a passive humidity controller capable of changing and maintaining the relative humidity of the air within the interior void space of the container, and/or a humidity sink like a condenser. Even more preferably, the air circulation device is a fan and the fan inlet is within the interior void space of the container so that at least a portion of the air within the void space of the container is recirculated. Preferably, for the optimum deodorisation, it preferred to have air velocities around the garment between 0.05 to 10 m/s, more preferably between 0.1 and 5, most preferably between 0.5 and 2 m.s-1. Also, there is preferably provided a filter in, or adjacent the exterior of the container.

The water and actives, that is, the "cleaning and refreshment composition" can be added to the container in any appropriate way. The composition can be poured into the bag, poured into a reservoir that feeds into the heating element humidifier, canisters can be used to inject the composition, or an absorbent substrate saturated with the composition can be placed in the bag. Substrates and compositions suitable for use in the methods of this invention are described in greater detail below. It is understood that those skilled in the art will know of other methods of adding actives to the container and those methods are within the scope of this invention.

Cleaning/Refreshment Composition

The cleaning/refreshment composition preferably comprises water and optionally a member selected from the group consisting of surfactants, perfumes, preservatives, bleaches, auxiliary cleaning agents, shrinkage reducing compositions, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol, ethanol, isopropanol and mixtures thereof. Fabric shrinkage reducing compositions that are suitable for use in the present invention are selected from the group consisting of ethylene glycol, all isomers of propanediol, butanediol, pentanediol, hexanediol and mixtures thereof. More preferably, the fabric shrinkage reducing compositions are selected from the group consisting of neopentyl glycol, polyethylene glycol, 1,2-propanediol, 1,3-butanediol, 1-octanol and mixtures thereof. The surfactant is preferably a nonionic surfactant, such as an ethoxylated alcohol or ethoxylated alkyl phenol, and is present at up to about 2%, by weight of the cleaning/refreshment composition. Typical fabric cleaning/refreshment compositions herein can comprise at least about 80%, by weight, water, preferably at least about 90%, and more preferably at least about 95% water.

The Examples below give specific ranges for the individual components of preferred cleaning/refreshment compositions for use herein. A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. The entire disclosure of the You et al. patent is incorporated herein by reference. Additionally, cleaning/refreshment compositions are described in co-pending U.S. patent application Ser. No. 08/789,171, which was filed on Jan. 24, 1997, in the name of Trinh et al. The entire disclosure of the Trinh et al. Application is incorporated herein by reference. And shrinkage reducing compositions for use in this invention can be found in co-pending U.S. Provisional Application No. 60/097,596, entitled "Cleaning Compositions that Reduce Fabric Shrinkage", which was filed by Strang and Siklosi, on Aug. 24, 1998. The entire disclosure of the Strang and Siklosi application is incorporated herein by reference.

Pre-treatment Composition

In one embodiment of this invention, the cleaning refreshment composition can be used to pre-treat the fabrics before their placement into the container defined in step a) of the present invention. Indeed, this pre-treatment of the fabrics has been found highly beneficial for the removal of clay like horse mud as well as of creamy or pasty deodorant stains that stick to localised part of the fabrics articles, e.g. fabric underarm. Further, this pre-treatment step has also been found beneficial for improving the deodorising as well as the dewrinkling performance of the apparatus on the treated fabrics. Accordingly, there is provided a method for treating the fabrics, whereby the fabrics are contacted with a cleaning/refreshing composition as defined herein prior to being placed in the container defined in step a). Preferably, the contacting occurs by spraying the fabrics with a hand-spray bottle commercially available under the reference 7292458 for the 1000 ml and 7292457 for the 500 ml from VEL or aerosol spray like the aluminium aerosol cans with polyethylene coating and a 18 bar pressure resistance as commercially available from Boxal part of the Algroup Wheaton. Suitable valves for the cans are aluminium cup spray valves from Seaquist. Preferably, the filling of the can by propellant is done with nitrogen at 10 bar for the initial pressure filling while the cans are filled with the pre-treatment composition up to 60% of the can total volume. Typical disclosure of such spray dispenser can be found in WO 96/04940 page 19 line 21 to page 22 line 27. Optionally, for more improved deodorising performance, cyclodextrin can be used, in particular β-cyclodextrin like the β-hydroxypropyl cyclodextrin or the β-methylated cyclodextrin, while for improved dewrinkling, lubricant like the D5 cyclomethicone from Dow Corning or diester quaternary ammonium compound like di(tallowyloxyethyl) dimethyl ammonium in the cleaning/refreshment composition. Typical levels of such cyclodextrin are of from 0.01, preferably of from 0.1% to 5% by weight.

Substrate

In one embodiment of this invention the cleaning/refreshment composition can be releasably absorbed in an absorbent substrate, herein after referred to as a "substrate". The substrate releasably contains the composition. By "releasably contains" means that the composition is effectively released from the substrate onto the soiled fabrics as part of the cleaning and fabric refreshment processes herein. This release occurs mainly by volatilization of the composition due to the heat from the supplemental heat source.

The substrate can be in any desired form, such as powders, flakes, shreds, and the like. However, it is highly preferred that the substrate be in the form of an integral pad or "sheet" that substantially maintains its structural integrity throughout the process. The substrates and sheets of this invention are sometimes referred to in the literature as "carriers" or "absorbent carrier sheets"; it is understood that all of these labels refer to liquid absorbing materials that can be used to conveniently transport liquids. Such substrates are described in detail in U.S. Pat. No. 5,789,368, to You et al. which was incorporated herein by reference above. The manufacture of these sheets forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al. Mar. 8, 1994, which are incorporated herein by reference.

The substrate is intended to contain a sufficient amount of the cleaning/refreshment composition to be effective for the intended purpose. The capacity of the substrate for such a composition will vary according to the intended usage. The size of the substrate should not be so large as to be unhandy for the user. Typically, the dimensions of the substrate will be sufficient to provide a macroscopic surface area (both sides of the substrate) of at least about 360 $cm^2$, preferably in the range from about 360 $cm^2$ to about 3000 $cm^2$. For example, a generally rectangular substrate may have the dimensions (X-direction) of from about 10 cm to about 35 cm, and (Y-direction) of from about 18 cm to about 45 cm.

In one preferred embodiment of this invention, the substrate is either a dark material, or is covered with a dark material, such as a black fabric. It is well known that dark materials absorb heat better than whiter materials. Thus, a dark substrate would tend to absorb more heat and volatilize more cleaning and refreshing composition if, for example, solar radiation is used as the supplemental heat source.

As discussed, the substrate can optionally be covered with a fibrous, preferably heat resistant and, most preferably, hydrophobic, coversheet as described in detail in U.S. Pat. No. 5,789,368, to You et al. which was incorporated herein by reference above. Additionally, co-pending U.S. provisional application 60/077,556, which was filed on Mar. 11, 1998, in the name of Wise et al., describes certain improvements to the coversheets of this invention. The entire disclosure of the Wise et al. application is incorporated herein by reference. Suitable combinations of the coversheets described in You et al. with the improvements described in Wise et al. can be employed, according to the desires of the manufacturer, without departing from the spirit and scope of the invention.

Spot Cleaning Composition

The user of the present process can be provided with various spot cleaning compositions to use in the optional pre-spotting procedure of this invention. These compositions are used to remove localized stains from the fabrics being treated, either before or after the cleaning and refreshing process defined herein. Necessarily, the spot cleaning composition must be compatible with the fabric being treated. That is, no meaningful amount of dye should be removed from the fabric during the spot treatment and the spot cleaning composition should leave no visible stains on the fabric. Therefore, in a preferred aspect of this invention there are provided spot cleaning compositions which are substantially free of materials that leave visible residues on the treated fabrics. This necessarily means that the preferred compositions are formulated to contain the highest level of volatile materials possible, preferably water, typically about 95%, preferably about 97.7%, and surfactant at levels of about 0.1% to about 0.7%. A preferred spot cleaning composition will also contain a cleaning solvent such as butoxy propoxy propanol (BPP) at a low, but effective, level, typically about 1% to about 4%, preferably about 2%.

Preferred spot cleaning methods and compositions are described in U.S. Pat. No. 5,789,368, to You et al. which was incorporated herein by reference above. Additionally, spot cleaning methods and compositions are described in U.S. Pat. No. 5,630,847, which issued on May 20, 1997, to Roetker. The entire disclosure of the Roetker patent is incorporated herein by reference.

Treatment Member

In one embodiment, a treatment member is provided to assist in removing localized stains from fabrics. In a preferred aspect of this invention, the spot cleaning composition is provided in a dispenser, such as a bottle, and the dispenser has a distal tip that can serve as the treatment member. Additionally, the treatment member can comprise an absorbent base material which can be, for example, a natural or synthetic sponge, an absorbent cellulosic sheet or pad, or the like. In contact with and extending outward from this base material can be multiple protrusions. Specific examples of treatment members can be found in U.S. Pat. No. 5,789,368, to You et al. which was incorporated herein by reference above.

Absorbent Stain Receiving Article

An absorbent stain receiving article, sometimes referred to herein as a stain receiver, can optionally be used in the optional pre-spotting operations herein. Such stain receivers can be any absorbent material which imbibes the liquid composition used in the pre-spotting operation. Disposable paper towels, cloth towels such as BOUNTY® brand towels, clean rags, etc., can be used. However, in a preferred mode the stain receiver is designed specifically to "wick" or "draw" the liquid compositions away from the stained area. One preferred type of stain receiver consists of a nonwoven pad, such as a thermally bonded air laid fabric ("TBAL"). Another highly preferred type of stain receiver for use herein comprises polymeric foam, wherein the polymeric foam comprises a polymerized water-in-iol emulsion, sometimes referred to as "poly-HIPE". The manufacture of polymeric foam is very extensively described in the patent literature: see, for example: U.S. Pat. No. 5,260,345 to DesMarais, Stone, Thompson, Young, LaVon and Dyer, issued Nov. 9, 1993; U.S. Pat. No. 5,550,167 to DesMarais, issued Aug. 27, 1996, and U.S. Pat. No. 5,650,222 to DesMarais et al., issued Jul. 22, 1997, all incorporated herein by reference. Typical conditions for forming the polymeric foams of the present invention are described in co-pending U.S. patent application Ser. No. 09/042,418, filed Mar. 13, 1998 by T. A. DesMarais, et al., titled "Absorbent Materials for Distributing Aqueous Liquids", the disclosure of which is incorporated herein by reference. Additional disclosure of conditions for forming the polymeric foams for use in the present invention are described in co-pending U.S. Provisional Patent Application Ser. No. 60/077,955, filed Mar. 13, 1998 by T. A. DesMarais, et al., titled "Abrasion Resistant Polymeric Foam And Stain Receivers Made Therefrom", the disclosure of which is incorporated herein by reference.

The various stain receivers described herein, and described in the references incorporated herein by reference, preferably comprise a liquid impermeable backsheet. The backsheet can be made of, for example, a thin layer of polypropylene, polyethylene and the like. The backsheet provides protection for the surface that the stain receiver rests on from the spot cleaning composition. For example, spot cleaning processes are typically performed on a hard surface, such as a table top. The stain receiver is placed on the table and the fabric to be treated in placed on the stain receiver. Spot cleaning composition is applied to the stained area of the fabric and then drawn into the stain receiver. But in the absence of a back sheet, the spot cleaning composition can leak onto the table top, possibly causing damage thereto.

The following Examples further illustrate the invention, but are not intended to be limiting thereof.

EXAMPLE I

Two extra-large men's jackets that have been exposed to cigarette smoke and wrinkled using standardized methods, are placed on clothes hangers. These jackets are then hung on the inside of a plastic bag that has two co-planer flat ends (the top and bottom) with the side walls being cylindrical and slightly outwardly bowed near the center. For illustration purposes only, the bag can be thought of as shaped like an egg shell with the top and bottom cut off. The container has a door for accessing the interior, and the door is closed with a zipper. A small slit near the bottom of the bag serves as the vent and the vent remains open at all times during this process.

On the interior of the bag is a fan, a heating element, a thermocouple and a reservoir that is in fluid communication with the heating element. Approximately 100 to 125 mls of a composition comprising approximately 99% water and 1% perfume, by weight, is poured into the reservoir and the door is closed.

An exterior "on/off" switch is turned on to begin the fabric refreshment process. The switch is connected to a programmable microprocessor that controls the multi-step process. First, the temperature is raised to about 70° C. with a relative humidity of about 50%. This is accomplished by running the fan and the heating element, with little or no cleaning and refreshment composition in contact with the heating element. This first step lasts for about 10 to 15 minutes. For the second step, the temperature is reduced to about 50° C. and the relative humidity is raised to greater than about 95%. This is accomplished through the introduction of the vaporized cleaning and refreshment composition. The fan continues to run during this second step, which lasts for about 7 to 9 minutes.

Finally, with the fan running the heating element is turned off and the interior of the bag cools naturally to about 45° C. in less than about 10 minutes. The fan is turned off automatically, and an indicator light signals that the process is complete. The jackets are removed and they are substantially wrinkle free, deodorized and ready to wear.

EXAMPLE II

Two extra-large men's jackets that have been exposed to cigarette smoke and wrinkled using standardized methods, are placed on clothes hangers. The areas with the most wrinkles were then pre-treated with a hand-held spray commercially available under the reference 7292457 from Vel and containing demineralised water so that the wrinkled areas were slightly damp but not soaked. These jackets are then hung on the inside of a plastic bag that has two co-planer flat ends (the top and bottom) with the side walls being cylindrical and slightly outwardly bowed near the center. For illustration purposes only, the bag can be thought of as shaped like an egg shell with the top and bottom cut off. The container has a door for accessing the interior, and the door is closed with a zipper. A vent is provided near the bottom of the bag, but the vent remains closed when the ozone is present in the bag.

On the interior of the bag is a fan, an ultra violet lamp, a heating element, a thermocouple and a receptacle for receiving a cartridge that contains a cleaning and refreshment composition. The receptacle is in fluid communication with the heating element. The cleaning and refreshment composition comprises approximately 100 to 125 mls of a composition comprising approximately 99% water and 1% perfume, by weight. After the cartridge is connected to the receptacle, the door is closed.

An exterior "on/off" switch is turned on to begin the fabric refreshment process. The switch is connected to a programmable microprocessor that controls the multi-step process. First, the ultraviolet lamp is turned on to produce ozone. The lamp remains lit for approximately 10 minutes. The fan is optionally run during this first step. For the second step, the temperature is raised to about 50° C. and the relative humidity is raised to greater than about 95%. This is accomplished through the introduction of the vaporized cleaning and refreshment composition. The fan continues to run during this second step, which lasts for about 7 to 12 minutes.

Finally, with the fan running the heating element is turned off and the interior of the bag cools naturally to about 45° C. in less than about 10 minutes. The fan is turned off automatically, and an indicator light signals that the process is complete. The jackets are removed and they are substantially wrinkle free, deodorized and ready to wear.

EXAMPLE III

Cleaning and Refreshing Compositions

While the cleaning and refreshment compositions of this invention can comprise water and perfume only, additional fabric treatment components can also be included. For example, fabric cleaning/refreshment compositions according to the present invention, for use in the methods described herein, are prepared as follows:

| Ingredient | % (wt.) Sheet | % (wt.) Cartridge |
|---|---|---|
| Emulsifier (TWEEN 20)* | 0.5 | 0 |
| Perfume | 0.5 | 0.5 |
| KATHON ® | 0.0003 | 0 |
| Sodium Benzoate | 0.1 | 0 |
| Water | Balance | Balance |

*Polyoxyethylene (20) sorbitan monolaurate available from ICI Surfactants.

Additionally, preferred compositions for use in the methods of this invention are as follows.

| Ingredient | % (wt.) | Range (% wt.) |
|---|---|---|
| Water | 99.0 | 95.1–99.9 |
| Perfume | 0.5 | 0.05–1.5 |
| Surfactant* | 0.5 | 0.05–2.0 |
| Ethanol or Isopropanol | 0 | Optional to 4% |
| Solvent (e.g. BPP) | 0 | Optional to 4% |
| Hydrogen peroxide | 0 | Optional to 4% |
| pH range from about 6 to about 8. | | |

EXAMPLE IV

Spot Cleaning Compositions

A spot cleaning composition for use in the present invention, preferably with a dispenser as defined above, and with a TBAL or poly-HIPE foam stain receiver, is prepared as follows:

| INGREDIENT | Anionic Composition (%) |
|---|---|
| Hydrogen peroxide | 1.000 |
| Amino tris(methylene phosphonic acid)* | 0.0400 |
| Butoxypropoxypropanol (BPP) | 2.000 |
| $NH_4$ Coconut $E_1S$ | 0.285 |
| Dodecyldimethylamine oxide | 0.031 |
| Magnesium chloride | 0.018 |
| Magnesium sulfate | 0.019 |
| Hydrotrope, perfume, other minors, | 0.101 |
| Kathon preservative | 0.0003 |
| Water (deionized or distilled) | 96.5 |
| Target pH | 6.0 |

*Stabilizer for hydrogen peroxide

Preferably, to minimize the potential for dye damage as disclosed hereinabove, $H_2O_2$-containing pre-spotting compositions comprise the anionic or nonionic surfactant in an amount (by weight of composition) which is less than the amount of $H_2O_2$. Preferably, the weight ratio of surfactant:$H_2O_2$ is in the range of about 1:10 to about 1:1.5, most preferably about 1:4 to about 1:3.

What is claimed is:

1. A method for treating a fabric article comprising the steps of:

placing the fabric article in a container having an opening and at least one wall that defines an interior void space;

contacting said fabric with a pre-treatment composition prior to said fabric being placed within the container;

raising the temperature and relative humidity of the air within the interior void space of the container to a predetermined first temperature and a predetermined first relative humidity for a predetermined first period of time; and changing at least one of the temperature or the relative humidity of the air within the interior void space of the container at the end of the first period of time to at least one of a predetermined second temperature or a predetermined second relative humidity for a predetermined second period of time.

2. The method according to claim 1 wherein a cartridge containing a cleaning and refreshing composition is introduced into the interior void space of the container, and the cleaning and refreshing composition is released from the cartridge into the interior void space of the container.

3. A method according to claim 1, wherein said contacting occurs by spraying.

4. The method according to claim 1, wherein vapor is used to raise the temperature and relative humidity of the air within the interior void space of the container.

5. The method according to claim 1, further comprising the step of allowing the temperature within the interior void space to decrease to a third temperature wherein the third temperature is less than about 45° C.

6. The method according to claim 1, wherein the container further comprises:

a) a heating element;

b) a humidity provider, preferably a humidity controller capable of changing and maintaining the relative humidity of the air within the interior void space of the container;

c) a vent and/or filter; and d) an air circulation device.

7. The method according to claim 6, wherein the container further comprises an active temperature controller capable of changing and maintaining the air temperature within the interior void space of the container.

8. The method according to claim 6, wherein the container further comprises a passive humidity controller capable of changing and maintaining the relative humidity of the air within the interior void space of the container.

9. The method according to claim 6, wherein the vent remains open at all times.

10. The method according to claim 6, wherein the air circulation device is a fan and the fan inlet is within the interior void space of the container so that at least a portion of the air within the void space of the container is recirculated.

11. The method according to claim 6, wherein the vent remains open at all times.

12. The method according to claim 1, wherein vapor is introduced into the interior void space of the container comprising water and a perfume.

13. The method according to claim 1, wherein the first temperature is at least about 45° C.

14. The method according to claim 1, wherein the second temperature is greater than T as defined by the equation: $T=60-(0.17*RH_2)$ wherein $RH_2$ is the second relative humidity in percent.

15. The method according to claim 14, wherein $RH_2$ is at least 50%.

16. The method according to claim 14, wherein the second temperature is less than about 45° C.

17. A method for treating a fabric article comprising the steps of:

placing the fabric article in a container having an opening and at least one wall that defines an interior void space;

raising the temperature and relative humidity of the air within the interior void space of the container to a predetermined first temperature and a predetermined first relative humidity for a predetermined first period of time;

raising at least one of the temperature or the relative humidity of the air within the interior void space of the container at the end of the first period of time to at least one of a predetermined second temperature or a predetermined second relative humidity for a predetermined second period of time; and decreasing the temperature of the air within the interior void space of the container at the end of the second period of time to a predetermined third temperature for a predetermined third period of time.

18. The method according to claim 17, wherein vapor is used to raise the temperature and relative humidity of the air within the interior void space of the container.

19. The method according to claim 17, wherein the third temperature is less than about 45° C.

20. The method according to claim 17, wherein the container further comprises:

a) a heating element;

b) a humidity provider, preferably a humidity controller capable of changing and maintaining the relative humidity of the air within the interior void space of the container;

c) a vent and/or filter; and d) an air circulation device.

21. The method according to claim 20, wherein the container further comprises an active temperature controller capable of changing and maintaining the air temperature within the interior void space of the container.

22. The method according to claim 20, wherein the container further comprises a passive humidity controller capable of changing and maintaining the relative humidity of the air within the interior void space of the container.

23. The method according to claim 20, wherein the air circulation device is a fan and the fan inlet is within the interior void space of the container so that at least a portion of the air within the void space of the container is recirculated.

24. The method according to claim 17, wherein vapor is introduced into the interior void space of the container comprising water and a perfume.

25. The method according to claim 17, wherein the first temperature is at least about 45° C.

26. The method according to claim 17, wherein the second temperature is greater than T as defined by the equation: $T=60-(0.17*RH_2)$ wherein $RH_2$ is the second relative humidity in percent.

27. The method according to claim 26, wherein $RH_2$ is at least 50%.

28. The method according to claim 26, wherein the second temperature is less than about 45° C.

29. The method according to claim 17 wherein a cartridge containing a cleaning and refreshing composition is introduced into the interior void space of the container, and the cleaning and refreshing composition is released from the cartridge into the interior void space of the container.

30. The method according to claim 17 wherein the fabric articles are stretched or tensioned prior to the start of the cycle.

31. The method according to claim 1 wherein the fabric articles are stretched or tensioned prior to the start of the cycle.

* * * * *